US007193586B2

(12) United States Patent
Lee et al.

(10) Patent No.: US 7,193,586 B2
(45) **Date of Patent: *Mar. 20, 2007**

(54) APPARATUS AND METHODS FOR DRIVING A PLASMA DISPLAY PANEL

(75) Inventors: Jun-Young Lee, Cheonan (KR); Hak-Ki Choi, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 445 days.

This patent is subject to a terminal disclaimer.

(21) Appl. No.: 10/610,873

(22) Filed: Jul. 2, 2003

(65) Prior Publication Data

US 2004/0135746 A1 Jul. 15, 2004

(30) Foreign Application Priority Data

Jul. 2, 2002 (KR) ..... 10-2002-0037897

(51) Int. Cl.
*G09G 3/28* (2006.01)

(52) U.S. Cl. ..... 345/60; 315/169.4

(58) Field of Classification Search ..... 345/60–69; 315/169.3, 169.4

See application file for complete search history.

(56) References Cited

U.S. PATENT DOCUMENTS 5,786,794 A * 7/1998 Kishi et al. ..... 345/60
6,281,635 B1 * 8/2001 Lee ..... 315/169.4
6,933,679 B2 * 8/2005 Lee et al. ..... 315/169.4
2002/0033675 A1 * 3/2002 Kang et al. ..... 315/169.1
2002/0175883 A1 * 11/2002 Onozawa et al. ..... 345/67
2004/0008163 A1 * 1/2004 Lee ..... 345/60

FOREIGN PATENT DOCUMENTS

JP 2002-062844 2/2002

* cited by examiner

*Primary Examiner*—Amr A. Awad
*Assistant Examiner*—Steven Holton
(74) *Attorney, Agent, or Firm*—H.C. Park & Associates, PLC

(57) ABSTRACT

In an apparatus for driving a plasma display panel, first and second switches are coupled in series between a power source $V_s$ and one terminal of a panel capacitor. Third and fourth switches are coupled in series between the one terminal of the panel capacitor and a power source $-V_s$. A contact of the first and second switches is coupled to a ground terminal while the one terminal of the panel capacitor is substantially fixed to a voltage of $-V_s$. A contact of the third and fourth switches is coupled to the ground terminal while the one terminal of the panel capacitor is substantially fixed to a voltage of $V_s$. Then, the withstand voltages of the first and second switches can be clamped to $V_s$ while the voltage of $-V_s$ is applied to the one terminal of the panel capacitor. Likewise, the withstand voltages of the third and fourth switches can be clamped to $V_s$ while the voltage of $V_s$ is applied to the one terminal of the panel capacitor.

16 Claims, 10 Drawing Sheets

APPARATUS AND METHODS FOR DRIVING A PLASMA DISPLAY PANEL

CROSS REFERENCE TO RELATED APPLICATION

This application is based on Korean Patent Application No. 2002-0037897 filed on Jul. 2, 2002. The content of the Application is fully incorporated by reference herein.

BACKGROUND OF THE INVENTION

1. Field of the Invention

The present invention relates to apparatus and methods for driving a plasma display panel (PDP).

2. Description of the Related Art

In recent years, flat panel displays such as liquid crystal displays (LCDs), field emission displays (FEDs), PDPs, and the like have been actively developed. PDPs are advantageous over other flat panel displays by providing high luminance, high luminous efficiency and wide view angles. Accordingly, PDPs are favorable as substitutes for conventional cathode ray tubes (CRT) for making large-scale screens of 40 inches or more.

A PDP is a flat panel display, that uses plasma generated by gas discharge, to display characters or images, and it includes, according to its size, more than several scores to millions of pixels arranged in a matrix pattern. Such a PDP is classified as a direct current (DC) type or an alternating current (AC) type according to the PDP's discharge cell structure and the waveform of the driving voltage applied thereto.

DC PDPs have electrodes exposed to a discharge space, allowing a direct current to flow through the discharge space while voltage is applied. Thus, for DC PDPs, resistors are used to limit the current. In contrast, AC PDPs have electrodes covered with a dielectric layer that naturally forms a capacitance component that limits the current and protects the electrodes from the impact of ions during a discharge. Thus, AC PDPs have longer lifetimes.

Typically, a driving method of AC PDPs is sequentially composed of a reset step, an addressing step, a sustain discharge step, and an erase step.

In the reset step, the state of each cell is initialized in order to readily perform an addressing operation on the cell. In the addressing step, wall charges are accumulated on selected "on"-state cells and other "on"-state cells (i.e., addressed cells) for selecting "off"-state cells on the panel. In the sustain discharge step, a sustain pulse is applied alternately to scan electrodes (hereinafter referred to as "Y electrodes") and sustain electrodes (hereinafter, referred to as "X electrodes") to perform a discharge for displaying an image on addressed cells.

In AC PDPs, the Y and X electrodes for such a sustain discharge act as a capacitive load, and a capacitance exists for the Y and X electrodes (hereinafter referred to as a "panel capacitor $C_p$").

Now, a description will be given as to a driver circuit for a conventional AC type PDP and its driving method.

FIG. 1 illustrates a conventional driver circuit and FIG. 2 illustrates an operating waveform of the conventional driver circuit illustrated in FIG. 1.

The driver circuit generating a sustain pulse, as suggested by Kishi et al. (Japanese Patent No. 3201603), comprises, as shown in FIG. 1, a Y electrode driver 11, an X electrode driver 12, a Y electrode power supplier 13, and an X electrode power supplier 14. The X electrode driver 12 and the X electrode power supplier 14 are the same in construction as the Y electrode driver 11 and the Y electrode power supplier 13, and will not be described in detail in the following description.

The Y electrode power supplier 13 comprises a capacitor $C_1$, and three switches $SW_1$, $SW_2$, and $SW_3$. The Y electrode driver 11 comprises two switches $SW_4$ and $SW_5$. The switches $SW_1$ and $SW_2$ in the Y electrode power supplier 13 are coupled in series between a power source $V_s$ and a ground voltage GND. One terminal of the capacitor $C_1$ is coupled to the contact of the switches $SW_1$ and $SW_2$, and the switch $SW_3$ is coupled between the other terminal of the capacitor $C_1$ and the ground voltage GND.

The switches $SW_4$ and $SW_5$ of the Y electrode driver 11 are coupled in series to both terminals of the capacitor $C_1$ of the Y electrode power supplier 13. The contact of the switches $SW_4$ and $SW_5$ is coupled to the panel capacitor $C_p$.

As shown in FIG. 2, when the switches $SW_4$ and $SW_4'$ are turned on, with the switches $SW_1$, $SW_3$, and $SW_2$, on and the switches $SW_2$, and $SW_5$ off, the Y electrode voltage $V_y$ is increased to $V_s$ and the capacitor $C_1$ is charged with the voltage $V_s$.

Subsequently, when the switch $SW_5$ is turned on, with the switch $SW_4$ off, the Y electrode voltage $V_y$ is decreased to the ground voltage. When the switches $SW_1$, $SW_3$, and $SW_4$ are turned off and the switches $SW_2$ and $SW_5$ are turned on, the Y electrode voltage $V_y$ is decreased to $-V_s$ by the voltage $V_s$ charged in the capacitor $C_1$. When the switch $SW_5$ is off and the switch $SW_4$ is on, the Y electrode voltage $V_y$ is increased to the ground voltage 0V.

Through this driving operation, positive voltage $+V_s$ and negative voltage $-V_s$ can be alternately applied to the Y electrodes. Likewise, positive voltage $+V_s$ and negative voltage $-V_s$ can be alternately applied to the X electrodes. The voltages $\pm V_s$ respectively applied to the X and Y electrodes have an inverted phase with respect to each other. By generating a sustain pulse swinging between $-V_x$ and $+V_s$, the potential difference between X and Y electrodes can be maintained at the sustain discharge voltage $2V_s$.

Such a driver circuit can employ elements of a low withstand voltage, because the withstand voltage of each element in the circuit is $V_s$. However, this driver circuit is applicable only to plasma display panels using a pulse swinging between $-V_s$ and $+V_s$.

In addition, the capacitor for storing the voltage used as a negative (−) voltage in this circuit must have a large capacity, so a considerable amount of an inrush current flows in an initial starting step due to the capacitor.

SUMMARY OF THE INVENTION

This invention provides apparatus and methods for driving a PDP which prevent an inrush current flow in an initial starting step.

This invention separately provides apparatus and methods for driving a PDP which use switches having a low withstand voltage.

This invention separately provides apparatus and methods for driving a PDP where the withstand voltage of the switches can be half of the voltage 2Vs necessary for a sustain discharge, thereby at least reducing the production unit cost.

This invention separately provides apparatus and methods for driving a PDP which reduces, and preferably eliminates, an inrush current generated when the voltage stored in an external capacitor is used in changing the terminal voltage of the panel capacitor.

This invention separately provides apparatus and methods for driving a PDP which can be used irrespective of the waveform of sustain pulses by changing the power source applied to it.

This invention separately provides an apparatus for driving a plasma display panel that includes a first driving section and a first clamping section. The first driving section includes first and second switches that are coupled in series between a first power source for supplying a first voltage and one terminal of a panel capacitor, and third and fourth switches coupled in series between the one terminal of the panel capacitor and a second power source for supplying a second voltage.

In an exemplary embodiment of the apparatus and methods according to this invention, the first clamping section includes fifth and sixth switches that are coupled between a contact of the first and second switches and a contact of the third and fourth switches, and a contact of the fifth and sixth switches that are coupled to a third power source for supplying a third voltage.

The first clamping section, in various exemplary embodiments of this invention, further includes first and second capacitors that are coupled in series between the first and second power sources and a contact of the first and second capacitors being coupled to a contact of the fifth and sixth switches.

In a second exemplary embodiment of this invention, the first driving section alternately applies the first and second voltages to the one terminal of the panel capacitor by a driving operation of the first and second switches and the third and fourth switches, respectively. In this exemplary embodiment the first clamping section includes a first signal line that is coupled between a contact of the first and second switches and a third power source for supplying a third voltage while the one terminal of the panel capacitor is substantially fixed to the second voltage, and a second signal line that is coupled between a contact of the third and fourth switches and the third power source while the one terminal of the panel capacitor is substantially fixed to the first voltage.

Preferably, in various exemplary embodiments of the apparatus and methods according to this invention the first clamping section further includes fifth and sixth switches formed on the first and second signal lines, respectively, and each has a body diode. The fifth switch is turned on, with the first and second switches off and the third and fourth switches on. The sixth switch is turned on, with the first and second switches on and the third and fourth switches off.

The first signal line causes the withstand voltages of the first and second switches to be clamped to the difference between the first and third voltages and the difference between the third and second voltages, respectively. The second signal line causes the withstand voltages of the third and fourth switches to be clamped to the difference between the first and third voltages and the difference between the third and second voltages, respectively.

Preferably, the driving apparatus according to the present invention further includes a power recovery section including at least one inductor coupled to the one terminal of the panel capacitor. The power recovery section changes a terminal voltage of the panel capacitor using a resonance generated between the inductor and the panel capacitor.

The power recovery section stores energy in the inductor and changes the terminal voltage of the panel capacitor using the energy stored in the inductor and the resonance, while the one terminal of the panel capacitor is sustained at the first or second voltage.

This invention separately provides a method for driving a plasma display panel by coupling a third voltage between a plurality of first switches formed on a second signal line, while one terminal of a panel capacitor is fixed to a first voltage through a first signal line, and coupling the third voltage between a plurality of second switches formed on a first signal line, while the one terminal of the panel capacitor is fixed to the second voltage through a second signal line.

Preferably, the voltage of the one terminal of the panel capacitor is raised to the first voltage using a resonance generated between an inductor coupled to the one terminal of the panel capacitor and the panel capacitor. The voltage of the one terminal of the panel capacitor is dropped to the second voltage using a resonance generated between the inductor and the panel capacitor.

Prior to changing the voltage of the one terminal of the panel capacitor, energy is stored in the inductor through a path of the third voltage, the inductor and the second signal line, or a path of the first signal line, the inductor and the third voltage.

These and other features and advantages of this invention are described in, or are apparent from, the following detailed description of various exemplary embodiments of the apparatus and methods according to this invention.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
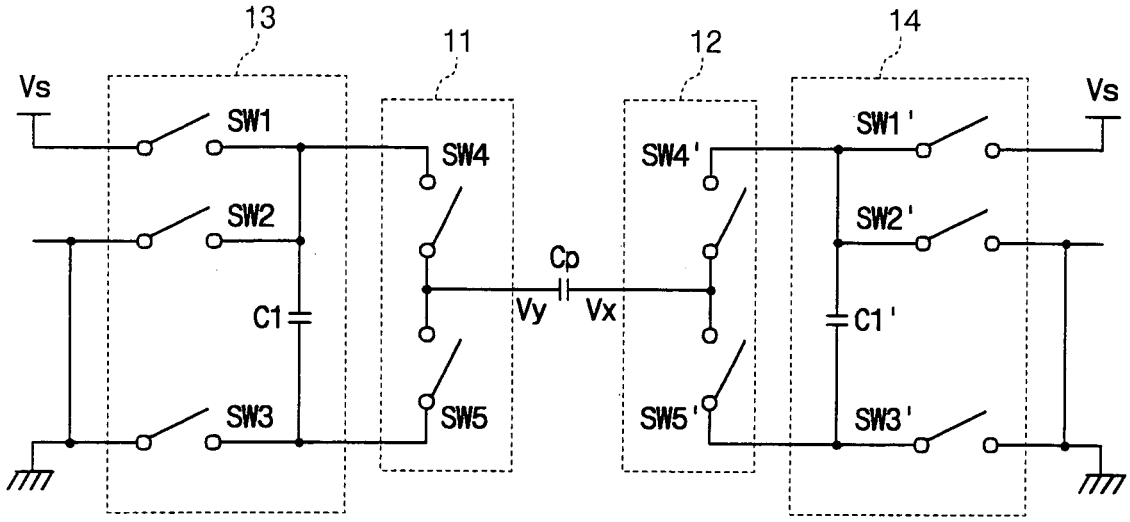
Fig. 1 (Prior Art)
FIG. 1 is a schematic of a known driver circuit.
Figure 2:
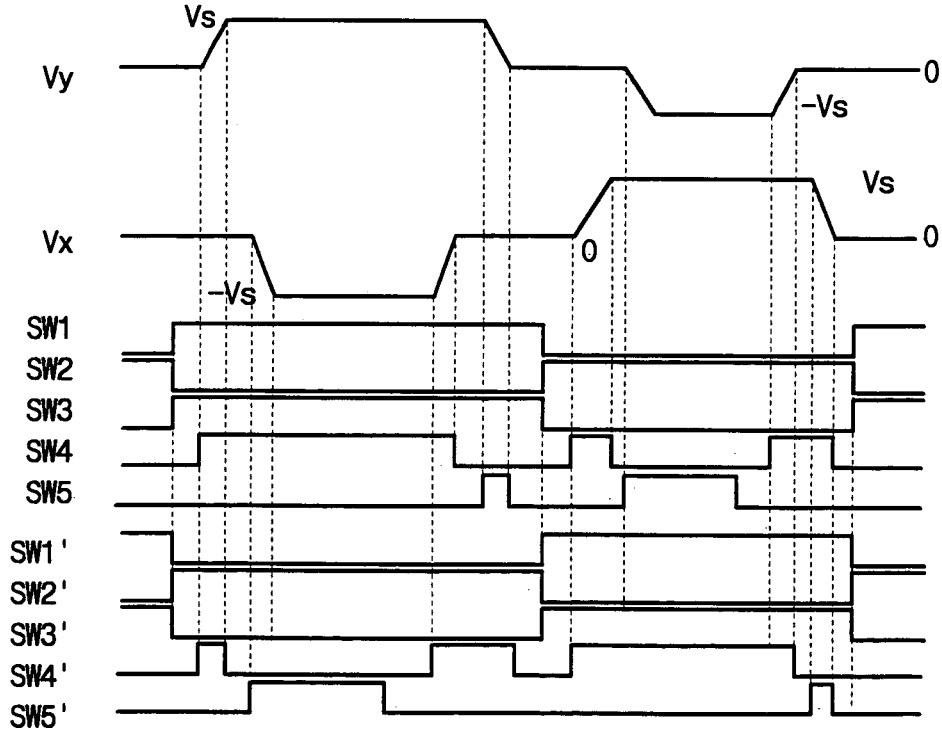
Fig. 2 (Prior Art)
FIG. 2 is a timing diagram showing a driving operation of the driver circuit according to the driver circuit illustrated in FIG. 1.

In the following detailed description, various exemplary embodiments of the invention have been shown and described, simply to illustrate a best mode contemplated by the inventors of carrying out the invention. As will be realized, the invention is capable of modification in various obvious respects, all without departing from the invention. Accordingly, the drawings and description are to be regarded as illustrative in nature, and not restrictive.

In the figures, some parts not related to the description are omitted for a better understanding of the present invention, and throughout the specification the same reference numeral is assigned to the same parts. The term "a part is coupled to another one" may include the case where the two parts are indirectly connected via, for example, a third element as well as the case where the two parts are directly connected together.

Hereinafter, a description will be given for an apparatus and method for driving an exemplary embodiment of a plasma display panel (PDP) according to this invention with reference to the accompanying drawings.

First, reference will be made to FIG. 3 to describe a schematic structure of an exemplary PDP according to this invention.

Figure 3:
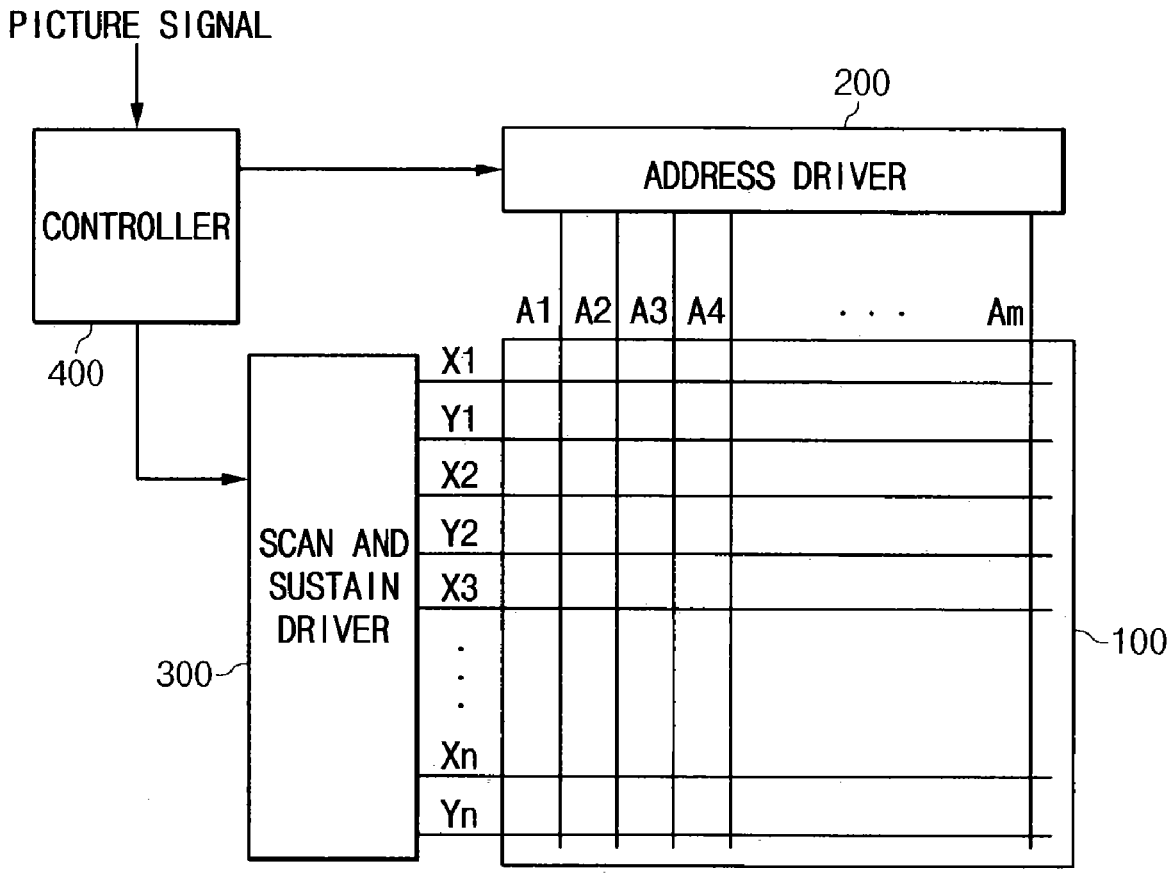
FIG. 3 is a schematic of a plasma display panel according to the present invention.

The PDP according to this exemplary embodiment of this invention comprises, as shown in FIG. 3, a plasma panel 100, an address driver 200, a scan/sustain driver 300, and a controller 400.

The plasma panel 100 comprises a plurality of address electrodes $A_1$ to $A_m$ arranged in rows, and a plurality of scan electrodes (hereinafter referred to as "Y electrodes") $Y_1$ to $Y_n$ and sustain electrodes (hereinafter referred to as "X electrodes") $X_1$ to $X_n$ alternately arranged in columns.

The address driver 200 receives an address drive control signal from the controller 400, and applies a display data signal for selection of discharge cells to be displayed to the individual address electrodes.

The scan/sustain driver 300 receives a sustain discharge signal from the controller 400, and applies a sustain discharge pulse alternately to the X and Y electrodes. The input sustain discharge pulse causes a sustain discharge on the selected discharge cells.

The controller 400 receives an external picture signal, generates the address drive control signal and the sustain discharge signal, and applies the address drive control signal and the sustain discharge signal to the address driver 200 and the scan/sustain driver 300, respectively.

Below is a description of a driver circuit of the scan/sustain driver 300 according to a first exemplary embodiment of the present invention with reference to FIGS. 4 to 6.

Figure 4:
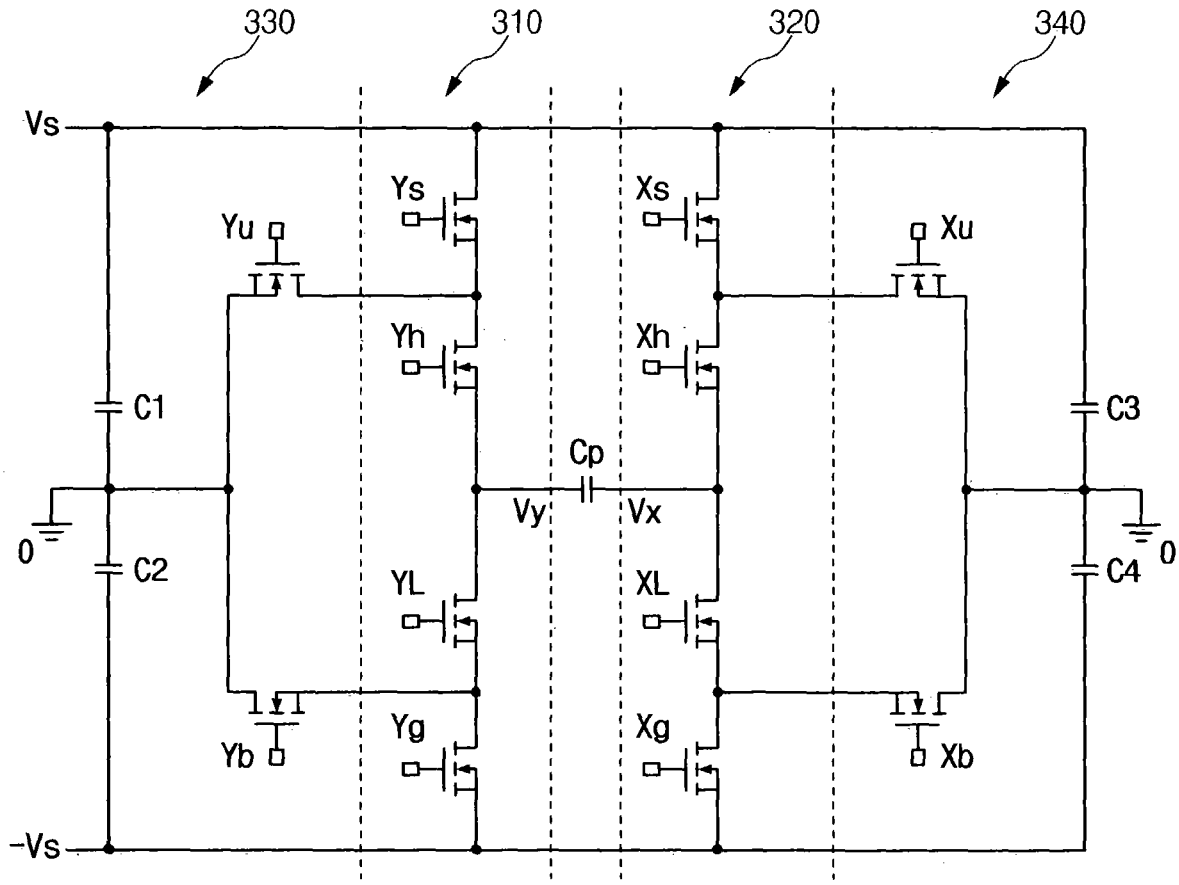
FIG. 4 is a circuit diagram showing a driver circuit of a plasma display panel according to a first exemplary embodiment of the present invention.

The driver circuit according to the first exemplary embodiment of the present invention comprises, as shown in FIG. 4, a Y electrode driver 310, an X electrode driver 320, a Y electrode clamping section 330, and an X electrode clamping section 340.

The Y electrode driver 310 and the X electrode driver 320 are coupled to each other with a panel capacitor $C_p$ therebetween. The Y electrode driver 310 comprises switches $Y_s$ and $Y_h$ which are coupled in series between a power source Vs and the Y electrodes of the panel capacitor $C_p$, and switches $Y_L$ and $Y_g$ coupled in series between the Y electrodes of the panel capacitor $C_p$ and the power source $-V_s$.

Likewise, the X electrode driver 320 comprises switches $X_s$ and $X_h$ that are coupled in series between the power source Vs and the X electrodes of the panel capacitor $C_p$, and switches $X_L$ and $X_g$ coupled in series between the X electrodes of the panel capacitor $C_p$ and the power source −Vs.

The Y clamping section 330 comprises switches $Y_u$ and $Y_b$, which are coupled between a contact of each of the switches $Y_s$ and $Y_h$ and the ground terminal and between a contact of each of the switches $Y_L$ and $Y_g$ and the ground terminal, respectively. The Y clamping section 330 may further comprise capacitors $C_1$ and $C_2$ for storing the voltages of the power sources Vs and −Vs that realize the actual circuit, respectively.

Likewise, the X clamping section 340 comprises switches $X_u$ and $X_b$, which are coupled between a contact of each of the switches $X_s$ and $X_h$ and the ground terminal and between a contact of each of the switches $X_L$ and $X_g$ and the ground terminal, respectively. The X clamping section 340 may further comprise capacitors $C_3$ and $C_4$ for storing the voltages of the power sources Vs and −Vs that realize the actual circuit, respectively.

Although the switches $Y_s$, $Y_h$, $Y_L$, $Y_g$, $Y_u$, $Y_b$, $X_s$, $X_h$, $X_L$, $X_g$, $X_u$, and $Y_b$ which are included in the Y and X electrode drivers 310 and 320 and the Y and X clamping sections 330 and 340 are denoted as a MOSFET in FIG. 4, they are not specifically limited to MOSFETs, and may include any switches that perform the same or similar functions. Preferably, the switches have a body diode.

Below is a description of a driving method of the driver circuit according to the first exemplary embodiment of the apparatus and methods of this invention with reference to FIGS. 5*a*, 5*b*, and 6.

Figure 5A:
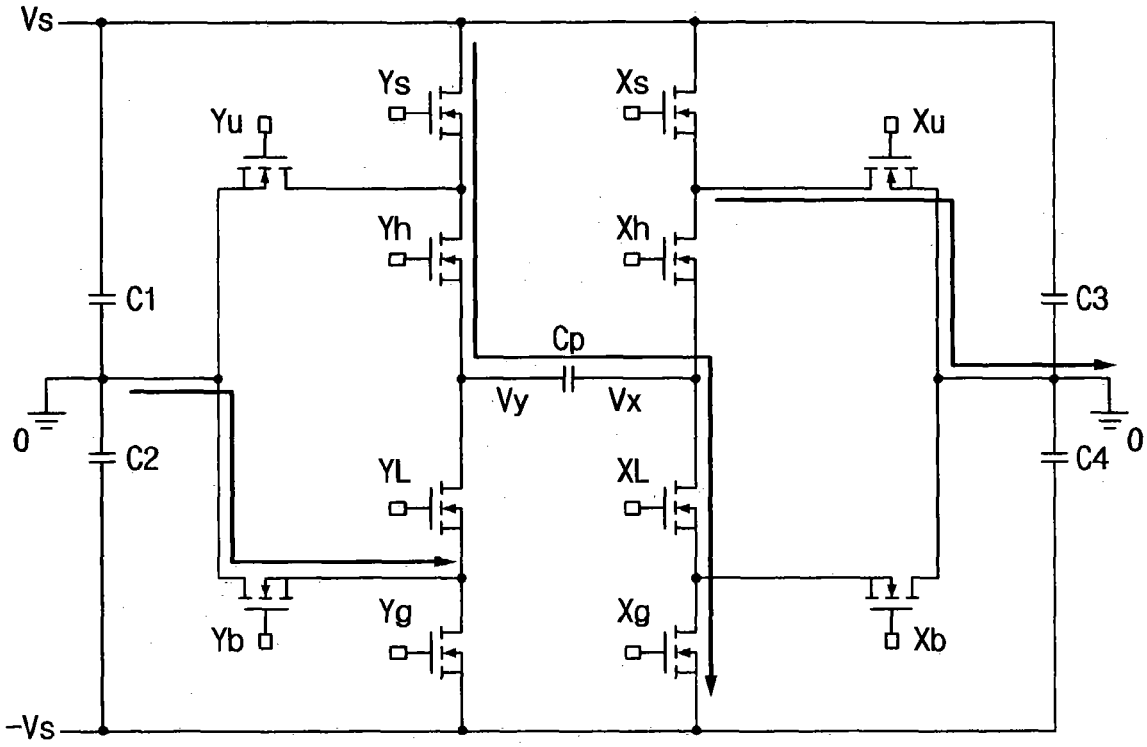
FIGS. 5*a* and 5*b* are illustrations showing a current path in each mode of the driver circuit according to the first exemplary embodiment of the present invention.
Figure 5B:
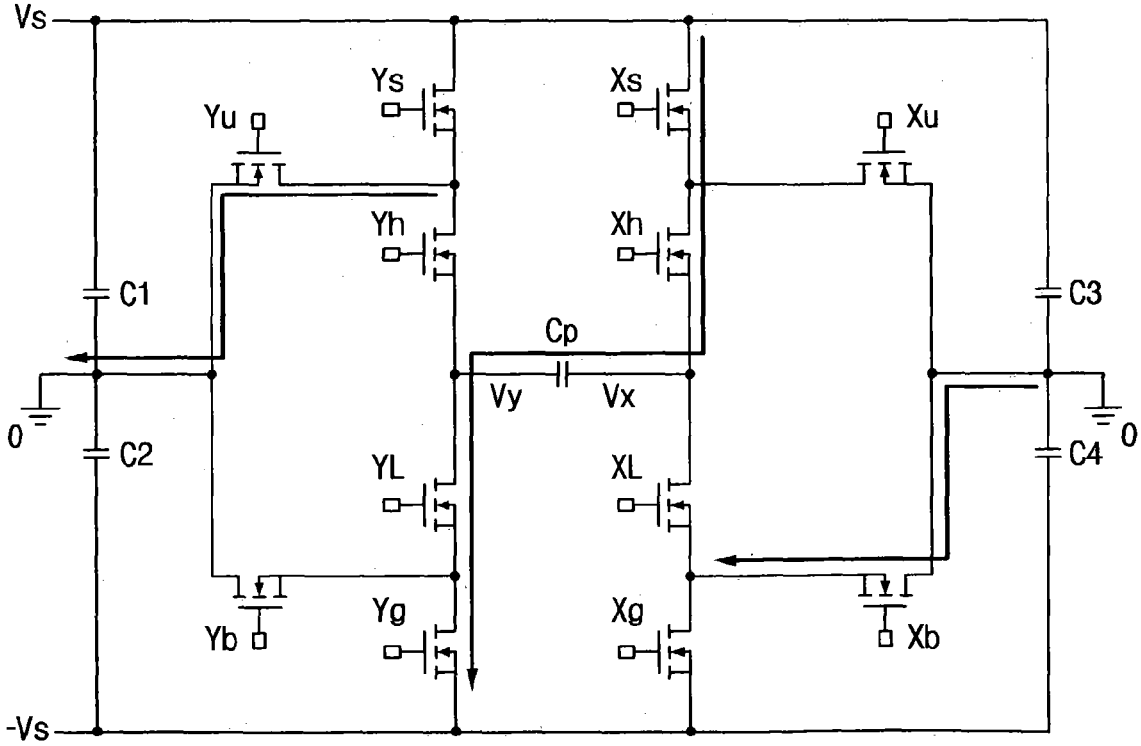
Figure 6:
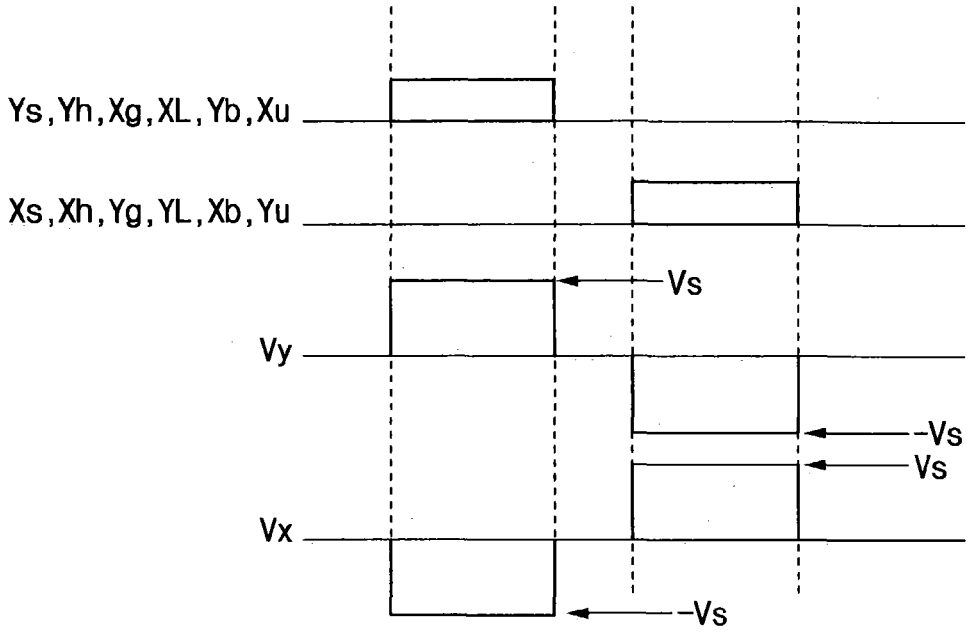
FIG. 6 is a timing diagram showing a driving operation of the driver circuits according to the first exemplary embodiment of the present invention.

FIGS. 5*a* and 5*b* are illustrations showing a current path in each mode of the driver circuit according to the first exemplary embodiment of the apparatus and methods of this invention, and FIG. 6 is a timing diagram showing a driving operation of the driver circuits according to the first exemplary embodiment of this invention.

In the first exemplary embodiment of the apparatus and methods of this invention, it is assumed that the voltages supplied by the power sources Vs and −Vs are $V_s$ and $-V_s$, respectively, and that the capacitors $C_1$, $C_2$, $C_3$, and $C_4$ are charged to the voltage $V_s$. It is also assumed that the voltage $V_s$ is a half of the sustain discharge voltage $2V_s$ which is necessary for a sustain discharge of the panel.

First, the operation in mode 1 (M1) will be described with reference to FIGS. 5*a* and 6. In mode 1, the switches $Y_s$, $Y_h$, $X_g$, $X_L$, $Y_b$, and $X_u$ are turned on, with the switches $X_s$, $X_h$, $Y_g$, $Y_L$, $X_b$, and $Y_u$ off.

The switches $Y_s$ and $Y_h$ in the on state cause the voltage $V_s$ of the power source Vs to be applied to the Y electrodes of the panel capacitor $C_p$, and the switches $X_L$ and $X_g$ in the on state cause the voltage $-V_s$ of the power source −Vs to be applied to the X electrodes of the panel capacitor $C_p$. The Y and X electrode voltages $V_y$ and $V_x$ of the panel capacitor $C_p$ are $V_s$ and $-V_s$, respectively, so that the voltage applied to both terminals of the panel capacitor is $2V_s$. Generally, a voltage of $2V_s$ necessary for a sustain discharge to be applied.

When the switch $Y_b$ is turned on, the voltage $V_s$ stored in the capacitor $C_1$ is applied to both terminals of the switch $Y_L$ via a loop of capacitor $C_1$, switches $Y_s$, $Y_h$, and $Y_L$, and the body diode of switch $Y_b$ and the voltage $V_s$ which is stored in the capacitor $C_2$ is applied to both terminals of the switch $Y_g$ via a loop of capacitor $C_2$ and switches $Y_b$ and $Y_g$.

When the switch $X_u$ is turned on, the voltage $V_s$ stored in the capacitor $C_3$ is applied to both terminals of the switch $X_s$ via a loop of capacitor $C_3$ and switches $X_s$ and $X_u$, and the voltage $V_s$ stored in the capacitor $C_4$ is applied to both terminals of the switch $X_h$ via a loop of capacitor $C_4$, the body diode of switch $X_u$ and switches $X_h$, $X_L$, and $X_g$.

Accordingly, the withstand voltages of the switches $Y_L$, $Y_g$, $X_s$, and $X_h$ in the off state are clamped to $V_s$ in mode 1.

Next, the operation in mode 2 (M2) will be described with reference to FIGS. 5*b* and 6. In mode 2, the switches $X_s$, $X_h$, $Y_g$, $Y_L$, $X_b$, and $Y_u$ are turned on, with the switches $Y_s$, $Y_h$, $X_g$, $X_L$, $Y_b$, and $X_u$ off.

The switches $Y_g$ and $Y_L$ in the on state cause the voltage $-V_s$ of the power source −Vs to be applied to the Y electrodes of the panel capacitor $C_p$, and the switches $X_s$ and $X_h$ in the on state cause the voltage $V_s$ of the power source Vs to be applied to the X electrodes of the panel capacitor $C_p$. The Y and X electrode voltages $V_y$ and $V_x$ of the panel capacitor $C_p$ are $-V_s$ and $V_s$, respectively, so that the voltage applied to both terminals of the panel capacitor is $-2V_s$. Namely, a voltage of $2V_s$ necessary for a sustain discharge to be applied.

When the switch $X_b$ is turned on, the voltage $V_s$ stored in the capacitor $C_3$ is applied to both terminals of the switch $X_L$ via a loop of capacitor $C_3$, switches $X_s$, $X_h$, and $X_L$ and the body diode of switch $X_b$, and the voltage $V_s$ stored in the capacitor $C_4$ is applied to both terminals of the switch $X_g$ via a loop of capacitor $C_4$ and switches $X_b$ and $X_g$.

When the switch $_u$ is turned on, the voltage $V_s$ stored in the capacitor $C_1$ is applied to both terminals of the switch $Y_s$ via a loop of capacitor $C_1$ and switches $Y_s$ and $Y_u$, and the voltage $V_s$, which is stored in the capacitor $C_2$ is applied to both terminals of the switch $Y_h$ via a loop of capacitor $C_s$, the body diode of switch $Y_u$ and switches $Y_h$, $Y_L$, and $Y_g$.

Thus, the withstand voltages of the switches $Y_s$, $Y_h$, $X_L$, and $X_g$ in the off state are clamped to $V_s$ in mode 2.

According to the first embodiment of the present invention, the switches $Y_u$, $Y_b$, $X_u$, and $X_b$ are operated to clamp the voltage applied to the switches $Y_s$, $Y_h$, $Y_L$, $Y_g$, $X_s$, $X_h$, $X_L$, and $X_g$ at $V_s$, so that switches having a low withstand voltage can be used for the switches $Y_s$, $Y_h$, $Y_L$, $Y_g$, $X_s$, $X_h$, $X_L$, and $X_g$. Furthermore, a high inrush current, such as the inrush current in the prior art is substantially avoided in the initial starting step because the capacitors $C_1$, $C_2$, $C_3$, and $C_4$ are not used for applying a negative (−) voltage to the Y or X electrodes of the panel capacitor $C_p$.

Because of the capacitance component of the panel capacitor $C_p$, a reactive power as well as the power for a discharge is required in applying a waveform for a sustain discharge. A circuit for recovering the reactive power and reusing it is called "power recovery circuit". Below is a description of another embodiment having a power recovery circuit added to the driver circuit according to the first exemplary embodiment of the apparatus and methods according to this invention with reference to FIGS. 7 to 9.

Figure 7:
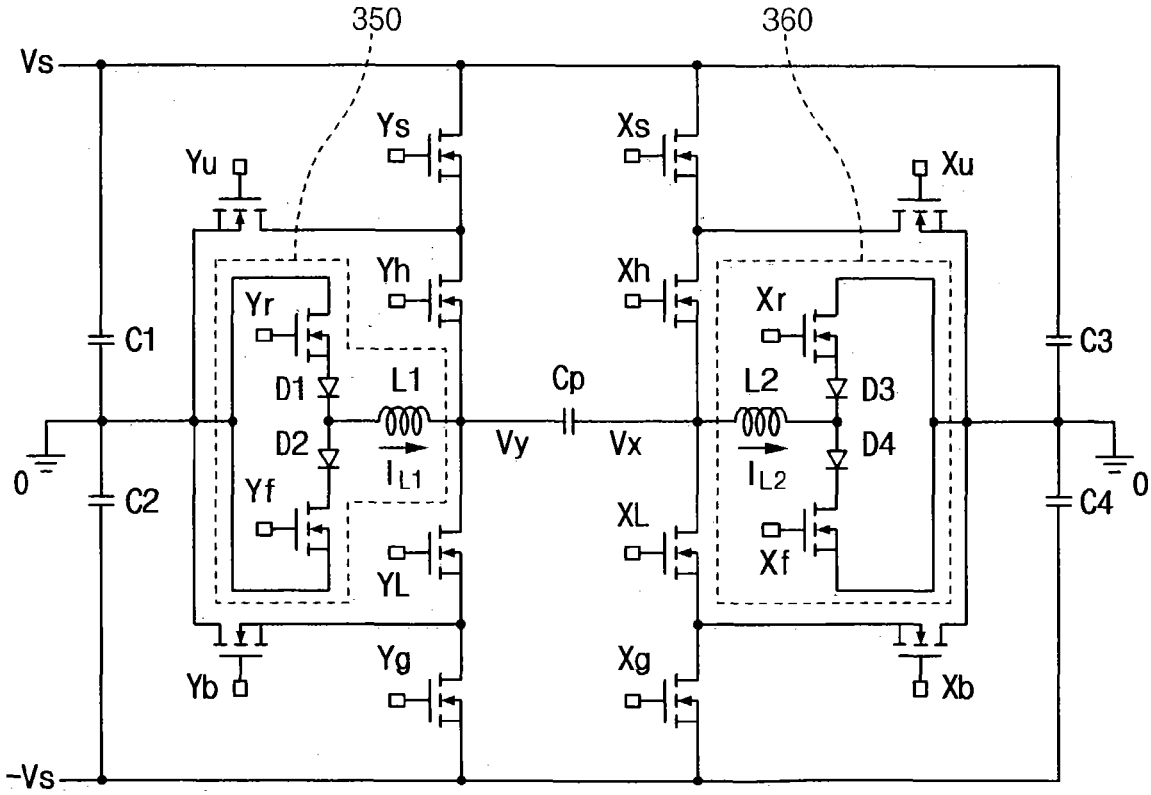
FIG. 7 is a circuit diagram showing a driver circuit of a plasma display panel according to a second exemplary embodiment of the present invention.

The driver circuit according to the second exemplary embodiment of the apparatus and methods according to this invention further comprises, as shown in FIG. 7, Y and X electrode power recovery sections 350 and 360 in addition to the features of the driver circuit according to the first exemplary embodiment of the present invention.

The Y electrode power recovery section 350 comprises an inductor $L_1$ and switches $Y_r$ and $Y_f$. The inductor $L_1$ has one terminal coupled to a contact of the switches $Y_h$ and $Y_L$, i.e., the Y electrodes of the panel capacitor $C_p$, and the switches $Y_r$ and $Y_f$ are coupled in parallel between the other terminal of the inductor $L_1$ and the ground terminal. The Y electrode power recovery section 350 further comprises diodes $D_1$ and $D_2$ coupled between the switch $Y_r$ and the inductor $L_1$ and between the switch $Y_f$ and the inductor $L_1$, respectively. The diodes $D_1$ and $D_2$ form a current path to the inductor $L_1$ and a current path from the inductor $L_1$.

The X electrode power recovery section 360 comprises an inductor $L_2$ and switches $X_r$ and $X_f$, and additionally includes diodes $D_3$ and $D_4$. The X electrode power recovery section 360 is the same in construction as the Y electrode power recovery section 350 and will not be described in detail. The switches $Y_r$, $Y_f$, $X_r$, and $X_f$ of the Y and X electrode power recovery sections 350 and 360 may comprise MOSFETs.

Below is a description of a driving method of the driver circuit according to the second exemplary embodiment of the apparatus and methods according to this invention with reference to FIGS. 8*a* to 8*h* and 9.

Figure 8A:
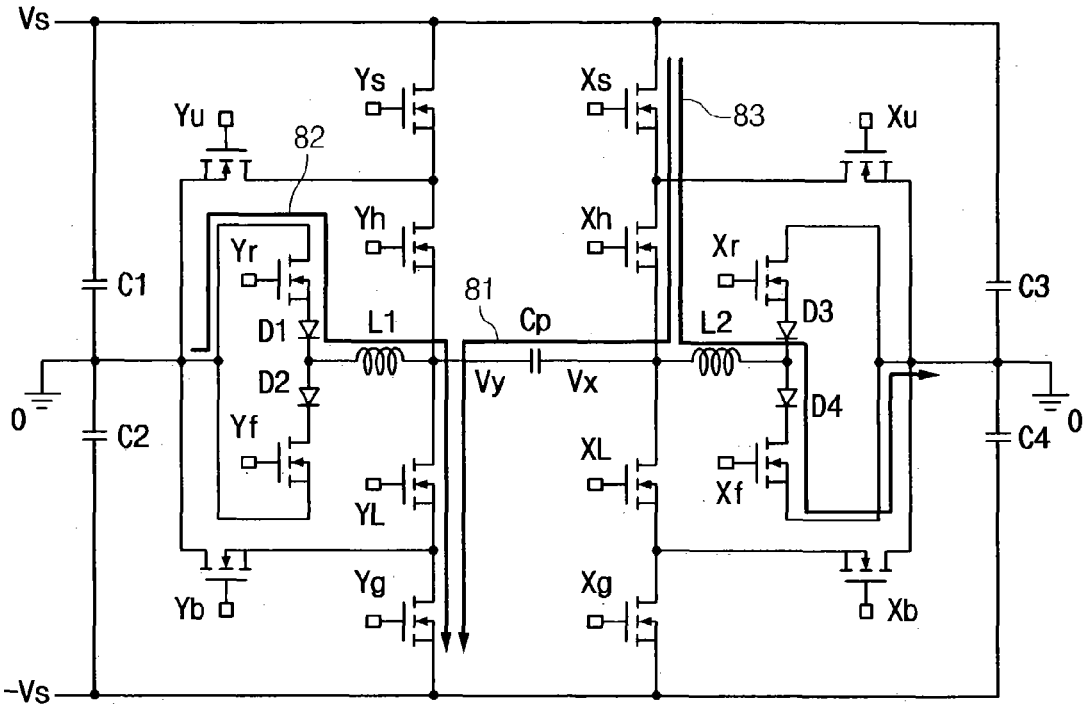
FIGS. 8*a* to 8*h* are illustrations showing a current path in each mode of the driver circuit according to the second exemplary embodiment of the present invention.
Figure 8B:
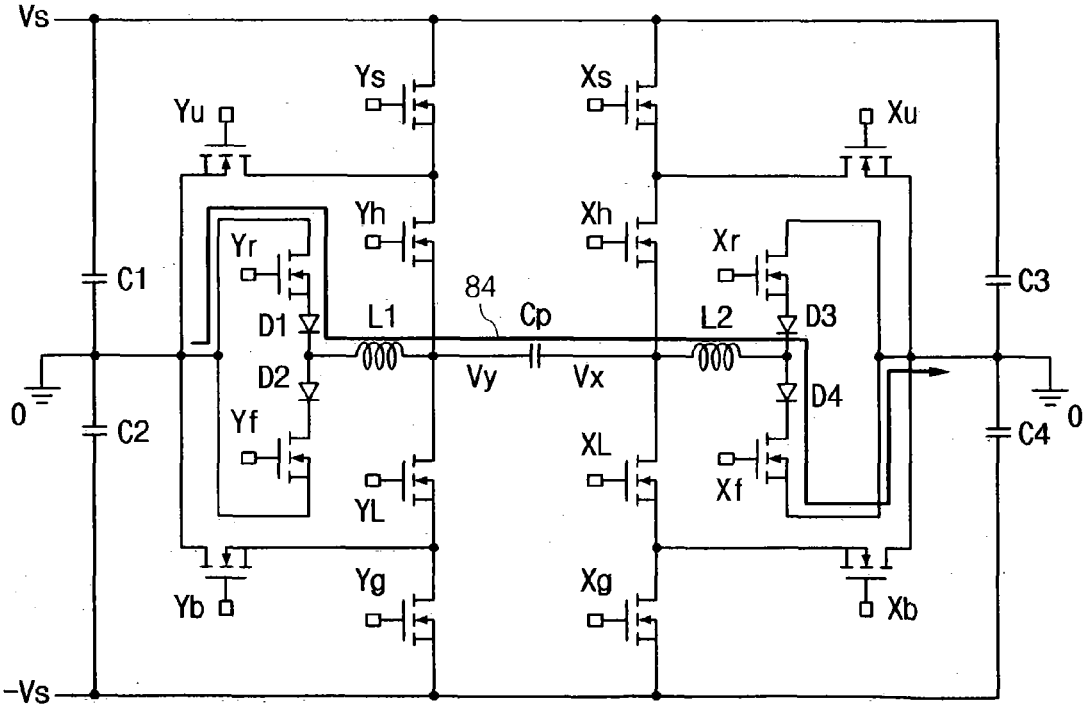
Figure 8C:
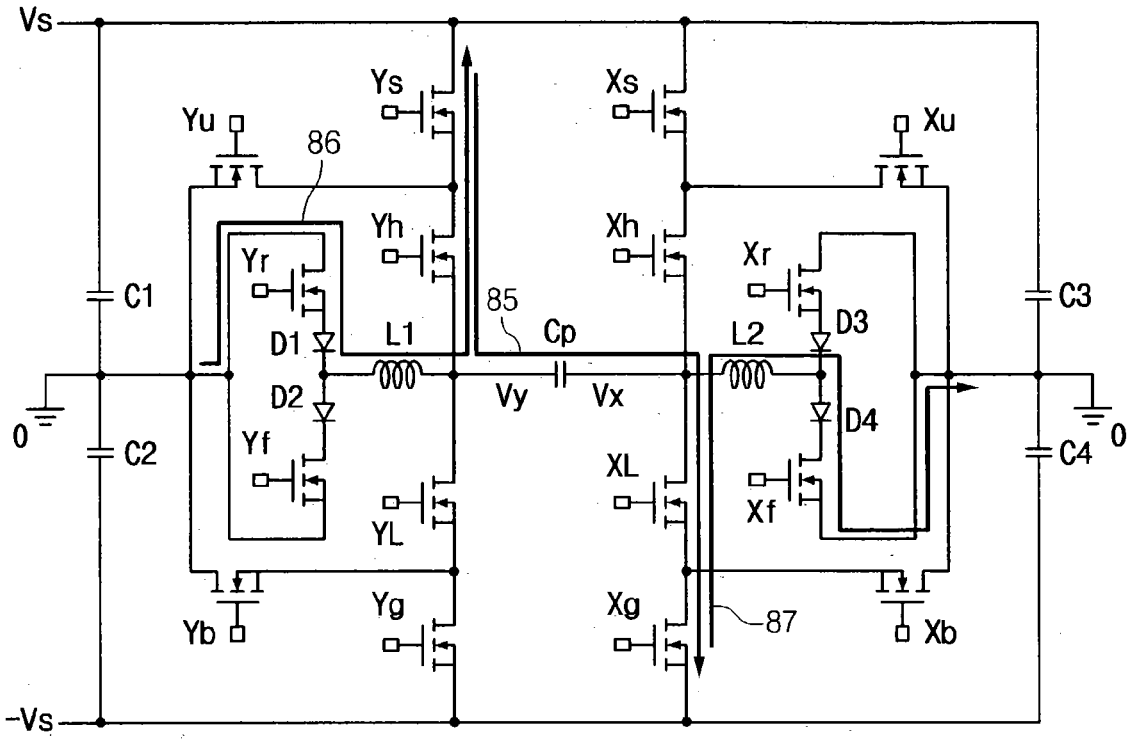
Figure 8D:
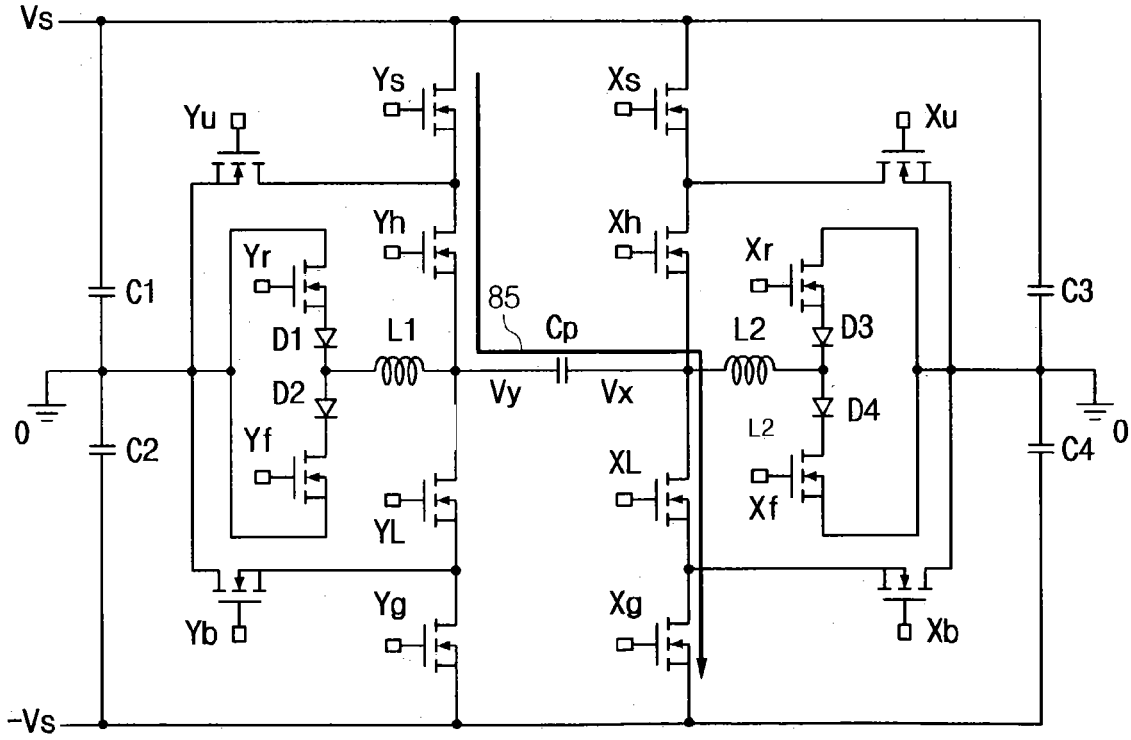
Figure 8E:
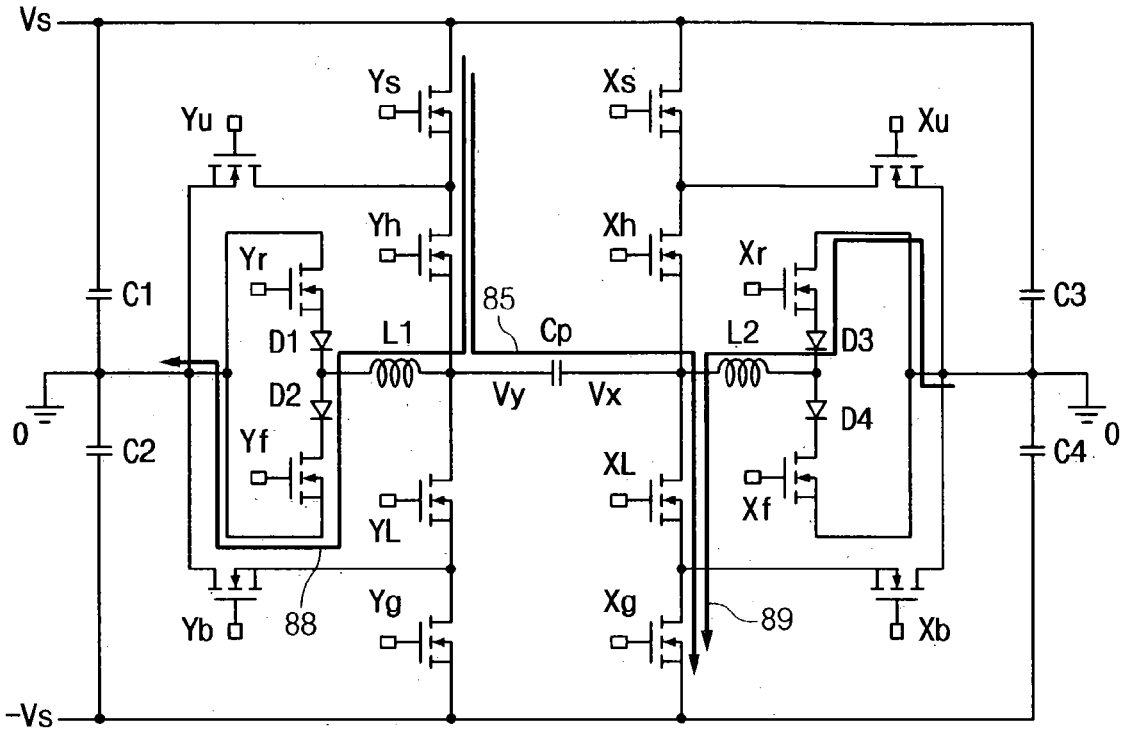
Figure 8F:
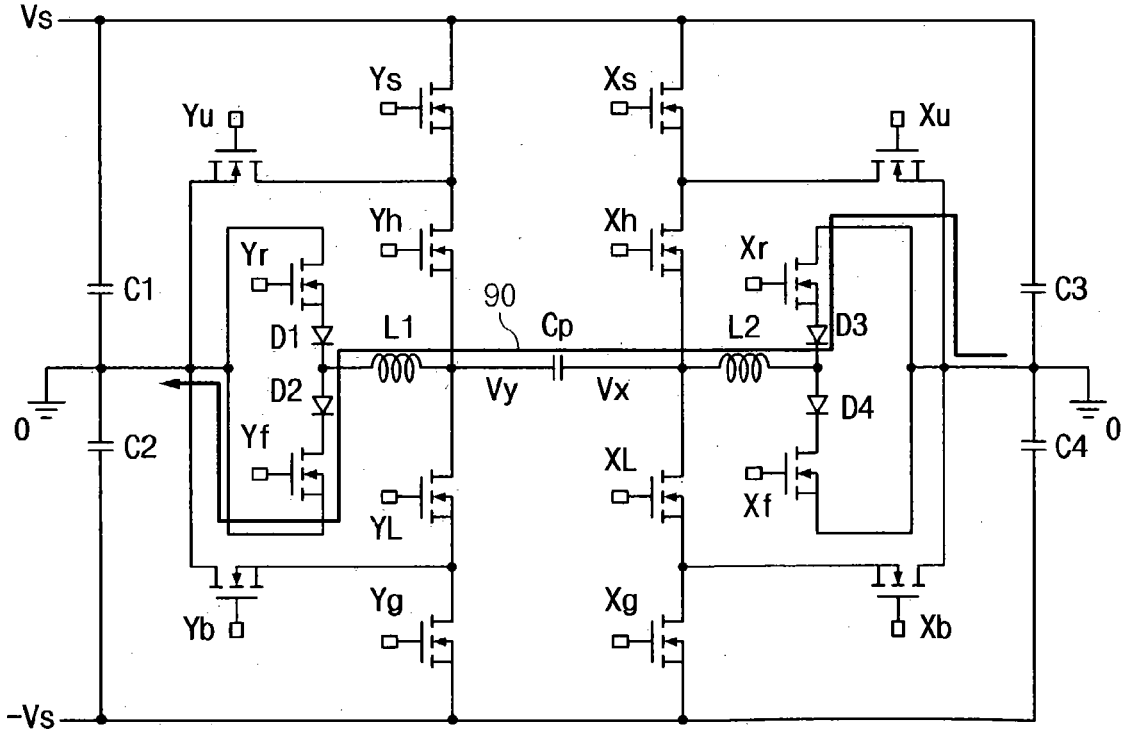
Figure 8G:
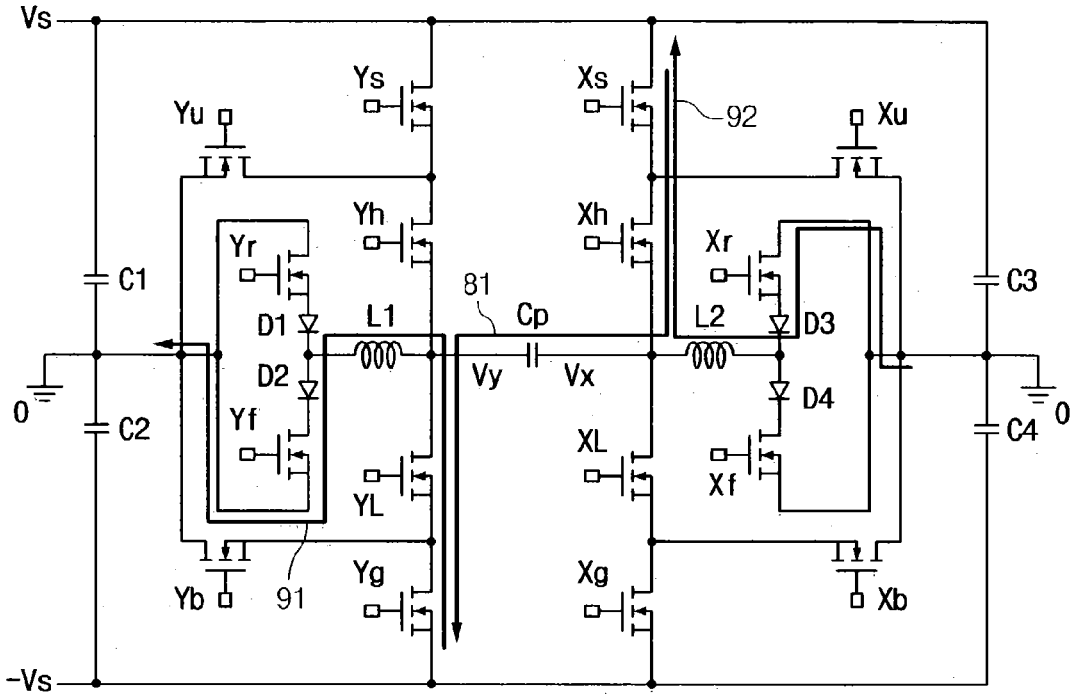
Figure 8H:
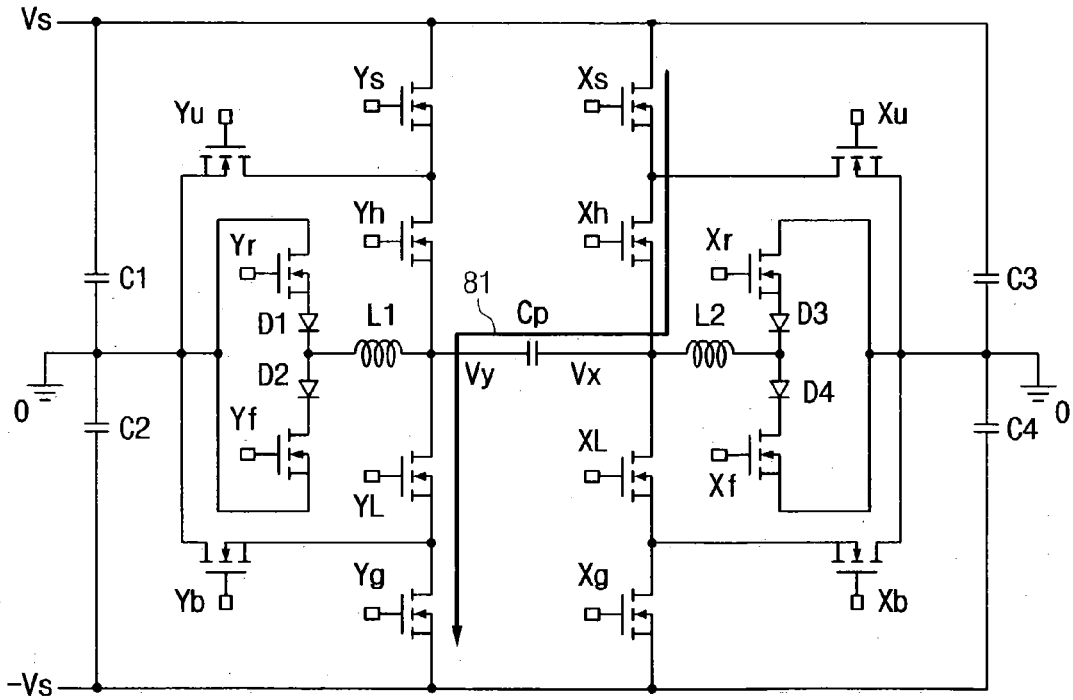
Figure 9:
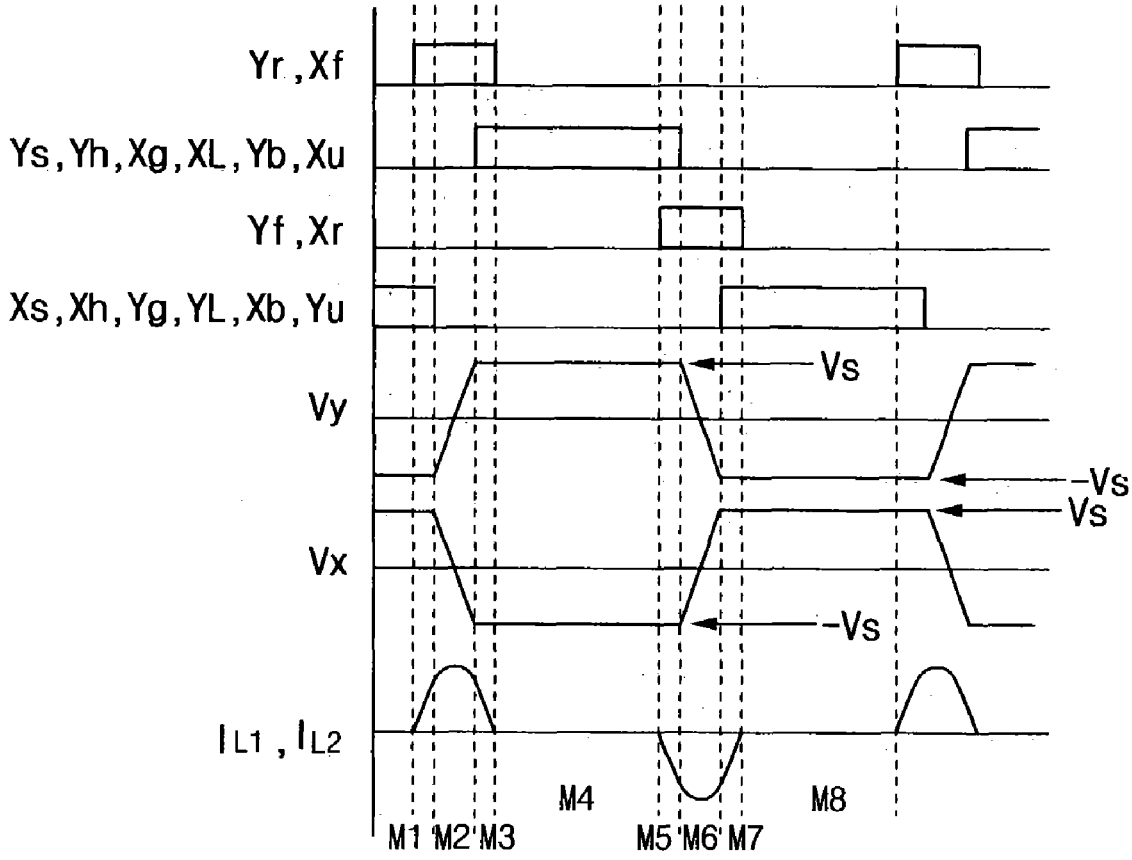
FIG. 9 is a timing diagram showing a driving operation of the driver circuits according to the second exemplary embodiment of the present invention.

FIGS. 8*a* to 8*h* are illustrations showing a current path in each mode of the driver circuit according to the second exemplary embodiment of the apparatus and methods according to this invention, and FIG. 9 is a timing diagram showing a driving operation of the driver circuits according to the second exemplary embodiment of the apparatus and methods according to this invention.

In the second embodiment of the present invention, it is assumed that before the start of the mode 1, the switches $X_s$, $X_h$, $Y_g$, $Y_L$, $X_b$, and $Y_u$ are in the on state, with the switches $Y_{Xg}$, $X_L$, $Y_f$, $X_f$, $Y_r$, $X_f$, $Y_b$, and $X_u$ off. It is also assumed that the capacitors $C_1$, $C_2$, $C_3$, and $C_4$ are charged to a voltage of $V_s$ and that the inductance of the inductors $L_1$ and $L_2$ is L.

(1) Mode 1 (M1)

Reference will be made to FIG. 8*a* and the M1 interval of FIG. 9 to describe the operation in mode 1.

Before the start of mode 1, a current path is formed that includes power source Vs, switches $X_s$ and $X_h$, panel capacitor $C_p$, switches $Y_L$ and $Y_g$, and power source −Vs. Then, the X electrode voltage $V_x$ of the panel capacitor $C_p$ is sustained at $V_s$ due to the power source $V_s$, and the Y electrode voltage $V_y$ of the panel capacitor $C_p$ is sustained at $-V_s$ due to the power source −Vs.

With the switch $X_b$ in the on state, the withstand voltages of the switches $X_L$ and $X_g$ are clamped to $V_s$ due to the voltage $V_s$ stored in the capacitors $C_3$ and $C_4$, as described in the first embodiment. Likewise, with the switch $Y_u$ in the on state, the withstand voltages of the switches, $Y_s$ and $Y_h$ are clamped to $V_s$ due to the voltage Vs stored in the capacitors $C_1$ and $C_2$, as described in the first embodiment.

When the switches $Y_r$ and $X_f$ are turned on, current paths 82 and 83 are formed. Current path 82 includes the ground terminal, switch $Y_r$, diode $D_1$, inductor $L_1$, switches $Y_L$ and $Y_g$, power source −Vs, and current path 83 includes power source Vs, switches $X_s$ and $X_h$, inductor $L_2$, diode $D_4$, switch $X_f$ and the ground terminal. Currents $I_{L1}$ and $I_{L2}$ flowing to the inductors $L_1$ and $L_2$ are linearly increased with a slope of $V_s/L$ through the current paths 82 and 83. Due to the currents $I_{L1}$ and $I_{L2}$, energy is stored in the inductors $L_1$ and $L_2$.

(2) Mode 2 (M2)

Reference will be made to FIG. 8*b* and the M2 interval of FIG. 9 to describe the operation in mode 2.

In mode 2, with the switches $Y_r$ and $X_f$ on, the switches $X_s$, $X_h$, $Y_g$, $Y_L$, $X_b$, and $Y_u$ are turned off. Then, a current path 84 is formed that includes switch $Y_r$, diode $D_1$, inductor $L_1$, panel capacitor $C_p$, inductor $L_2$, diode $D_4$, and switch $X_f$, so that an LC resonance current flows due to the inductors $L_1$ and $L_2$ and the panel capacitor $C_p$. With this LC resonance current, the Y electrode voltage $V_y$ of the panel capacitor $C_p$ is increased to $V_s$ and the X electrode voltage $V_x$ is reduced to $-V_s$. The Y and X electrode voltages $V_y$ and $V_x$ do not exceed $V_s$ and $-V_s$ due to the body diodes of the switches $Y_s$ and $Y_h$ and the switches $X_L$ and $X_g$, respectively.

As described above, energy is previously stored in the inductors $L_1$ and $L_2$, and the stored energy and the resonance current are used for changing the Y and X electrode voltages $V_y$ and $V_x$ of the panel capacitor $C_p$. Thus, the Y and X electrode voltages $V_y$ and $V_x$ can be changed to $V_s$ and $-V_s$, respectively, even in the actual circuit including parasitic components.

(3) Mode 3 (M3)

Reference will be made to FIG. 8*c* and the M3 interval of FIG. 9 to describe the operation in mode 3.

In mode 3, with the switches $Y_r$ and $X_f$ on, the switches $Y_s$, $Y_h$, $X_g$, and $X_L$ are turned on. Then, a current path 85 is formed that includes power source Vs, switches $Y_s$ and $Y_h$, panel capacitor $C_p$, switches $X_L$ and $X_g$, and power source −Vs. Due to the power sources Vs and −Vs, the Y and X electrode voltages $V_y$ and $V_x$ of the panel capacitor $C_p$ are is sustained at $V_s$ and $-V_s$, respectively.

The current $I_{L1}$ flowing to the inductor $L_1$ is recovered to the power source Vs through a current path 86 that includes switch $Y_r$, diode $D_1$, inductor $L_1$, the body diode of switch $Y_h$, and the body diode of switch $Y_s$. The current $I_{L2}$ flowing to the inductor $L_2$ is recovered to the ground terminal through a current path 87 that includes the body diode of switch $X_g$, the body diode of switch $X_L$, inductor $L_2$, diode $D_4$, and switch $X_f$.

When the switch $Y_b$ is turned on, the withstand voltages of the switches $Y_L$ and $Y_g$ in the off state are clamped to $V_s$ due to the voltage $V_s$ stored in the capacitors $C_1$ and $C_2$, respectively. Likewise, when the switch $X_u$ is turned on, the withstand voltages of the switches $X_s$ and $X_h$ are clamped to $V_s$ due to the voltage $V_s$ stored in the capacitors $C_3$ and $C_4$, respectively.

(4) Mode 4 (M4)

Reference will be made to FIG. 8*d* and the M4 interval of FIG. 9 to describe the operation in mode 4.

In mode 4, with the switches $Y_s$, $Y_h$, $X_g$, $X_L$, $Y_b$, and $X_u$ on, the switches $Y_r$ and $X_f$ are turned off. By the current path 85 formed in Mode 3, the Y and X electrode voltages $V_y$ and $V_x$ of the panel capacitor $C_p$ are still sustained at $V_s$ and $-V_s$, respectively. And, the switches $Y_b$ and $X_u$ in the on state cause the withstand voltages of the switches $X_s$, $X_h$, $Y_L$, and $Y_g$ to be clamped to $V_s$.

(5) Mode 5 (M5)

Reference will be made to FIG. 8*e* and the M5 interval of FIG. 9 to describe the operation in mode 5.

In mode 5, with the switches $Y_s$, $Y_h$, $X_g$, $X_L$, $Y_b$, and $X_u$ on, the switches $Y_f$ and $X_f$ and $x_r$ are turned on. By the current path 85, the Y and X electrode voltages $V_y$ and $V_x$ of the panel capacitor $C_p$ are still sustained at $V_s$ and $-V_s$, respectively.

With the switches $Y_f$ and $X_r$ on, a current path 88 is formed that includes power source Vs, switches $Y_x$ and $Y_h$, inductor $L_1$, diode $D_2$, switch $Y_f$, and the ground terminal, and a current path 89 is formed that includes the ground terminal, switch $X_r$, diode $D_3$, inductor $L_2$, switches $X_L$ and $X_g$, and power source −Vs. By the current paths 88 and 89, the magnitude of currents $I_{L1}$ and $I_{L2}$ flowing to the inductors $L_1$ and $L_2$ are linearly increased with a slope of $V_s/L$ (these currents are opposite in direction to those in mode 1 and are denoted as a negative (−) value in FIG. 9). Hence the energy is stored in the inductors $L_1$ and $L_2$.

The switches $Y_b$ and $X_u$ in the on state cause withstand voltages of the switches $X_s$, $X_h$, $Y_L$, and $Y_g$ to always be clamped to $V_s$.

(6) Mode 6 (M6)

Reference will be made to FIG. 8*f* and the M6 interval of FIG. 9 to describe the operation in mode 6.

In mode 6, with the switches $Y_f$ and $X_r$ on, the switches $Y_s$, $Y_h$, $X_g$, $X_L$, $Y_b$, and $X_u$ are turned off. Then, a current path 90 is formed that includes switch $X_r$, diode $D_3$, inductor $L_2$, panel capacitor $C_p$ inductor $L_1$, diode $D_2$, and switch $Y_f$. The current path 90 makes an LC resonance current flow due to the inductors $L_1$ and $L_2$ and the panel capacitor $C_p$. With this LC resonance current, the Y electrode voltage $V_y$ of the panel capacitor $C_p$, is decreased to $-V_x$ and the X electrode voltage $V_x$ is increased to $V_s$. The Y and X electrode voltages $V_y$ and $V_x$ do not exceed $-V_s$ and $V_s$ due to the body diodes of the switches $Y_L$ and $Y_g$ an d the switches $X_s$ and $X_h$, respectively.

As described in mode 2, the energy stored in the inductors $L_1$ and $L_2$ is used, so that the Y and X electrode voltages $V_y$ and $V_x$ can be changed to $-V_s$ and $V_s$, respectively, even in the actual circuit including parasitic components.

(7) Mode 7 (M7)

Reference will be made to FIG. 8*g*, and the M7 interval of FIG. 9 to describe the operation in mode 7.

In mode 7, with the switches $Y_f$ and $X_r$ on, the switches $X_s$, $X_h$, $Y_g$, and $Y_L$ are turned on. A current path 81 is then formed that includes power source Vs, switches $X_s$ and $X_h$, panel capacitor $C_p$ switches $Y_L$ and $Y_g$, and power source −Vs. Due to the power sources Vs and −Vs, the Y and X electrode voltages $V_y$ and $V_x$ of the panel capacitor $C_p$ are sustained at $V_s$ and $-V_s$, respectively.

The current $I_{L1}$ flowing to the inductor $L_1$ is recovered to the ground terminal through a current path 91 that includes the body diode of switch $Y_g$, the body diode of switch $Y_L$, inductor $L_1$, diode $D_2$, and switch $Y_f$. The current $I_{L2}$ flowing to the inductor $L_2$ is recovered to the power source Vs through a current path 92 that includes switch $X_r$, diode $D_3$, inductor $L_2$, the body diode of switch $X_h$ and the body diode of switch $X_s$. Namely, the magnitude of currents $I_{L1}$ and $I_{L2}$ flowing to the inductors $L_1$ and $L_2$ are linearly decreased to zero with a slope of $V_s/L$.

As described above in regard to mode 1, the switches $Y_u$ and $X_b$ in the on state cause the withstand voltages of the switches $Y_s$, $Y_h$, $X_L$, and $X_g$ to always be clamped to $V_s$.

(8) Mode 8 (M8)

Reference will be made to FIG. 8*h* and the M8 interval of FIG. 9 to describe the operation in mode 8.

In mode 8, with the switches $X_s$, $X_h$, $Y_g$, $Y_L$, $X_b$, and $Y_u$ on, the switches $Y_f$ and $X_r$ are turned off. By the current path 81 formed in mode 7, the Y and X electrode voltages $V_y$ and $V_x$ of the panel capacitor $C_p$ are still sustained at $-V_x$ and $V_s$, respectively. As described above in regard to mode 7, the switches $Y_u$ and $X_b$ in the on state cause the withstand voltages of the switches $Y_s$, $Y_h$, $X_L$, and $X_g$ to always be clamped to $V_s$.

Subsequently, the cycle of modes 1 to 8 is repeated to generate Y and X electrode voltages $V_y$ and $V_x$ swinging between $V_s$ and $-V_s$, thereby sustaining the potential difference between the X and Y electrodes at a sustain discharge voltage of $2V_s$.

Although each of the Y and X electrode power recovery sections 350 and 360 has one inductor in the second embodiment of the present invention, all other differently modified power recovery sections may be used. For example, the Y electrode power recovery section 350 may include inductors $L_{11}$ and $L_{12}$ each forming a different path. More specifically, energy is stored in the inductor $L_{11}$ while the Y electrode voltage is sustained at $V_s$, and then used to change the Y electrode voltage to $-V_s$. The energy stored in the inductor $L_{11}$ is recovered and the energy is stored in the inductor $L_{12}$, while the Y electrode voltage sustained at $-V_s$. The energy stored in the inductor $L_{12}$ is used to change the Y electrode voltage to $V_s$.

In these embodiments of the present invention, it is assumed that the capacitors $C_1$, $C_2$, $C_3$, and $C_4$ are present in the driver circuit and the voltages stored in the capacitors are used for applying a withstand voltage to the switches. As described above, however, the capacitors $C_1$, $C_2$, $C_3$, and $C_4$ may not be included in the circuit, in which case the withstand voltage is applied to the switches by the power sources $V_s$ and $-V_s$.

Although the voltages supplied by the power sources Vs and −Vs are $V_s$ and $-V_s$, respectively, in the first and second embodiments of the present invention, a different voltage can also be used as long as the voltage difference between the two power sources is $2V_s$, necessary for a sustain discharge. Namely, the voltages supplied by the power sources Vs and −Vs can be $V_h$ and $(V_h-2V_s)$ so that the Y and X electrode voltages $V_y$ and $V_x$ swing between $V_h$ and $(V_h-2V_s)$.

Although two switches are coupled between the power source and the X or Y electrode of the panel capacitor $C_p$ in the first and second embodiments of the present invention, the number of switches is not specifically limited in the present invention. For example, when four switches $S_1$, $S_2$, $S_3$, and $S_4$ are coupled in series between the power source Vs and the Y electrode of the panel capacitor and the switch $Y_u$ is coupled to the contact of the switches $S_2$ and $S_3$, the withstand voltage of the switches $S_1$ and $S_2$ or the switches $S_3$ and $S_4$ is $V_s$.

According to this invention, the withstand voltage of the switches can be half of the voltage $2V_s$ necessary for a sustain discharge, thereby reducing the production unit cost. The present invention also reduces, and preferably eliminates, an inrush current generated when the voltage stored in an external capacitor is used in changing the terminal voltage of the panel capacitor. Furthermore, the driver circuit of this invention can be used irrespective of the waveform of sustain pulses by changing the power source applied to it.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for driving a plasma display panel, which has a panel capacitor, the apparatus comprising:

a first driving section including first and second switches which are coupled in series between a first power source for supplying a first voltage and a first terminal of the panel capacitor, and third and fourth switches which are coupled in series between the first terminal of the panel capacitor and a second power source for supplying a second voltage; and a first clamping section including a fifth switch and a sixth switch, wherein a first terminal of the fifth switch is directly connected to a node between the first switch and the second switch, a second terminal of the fifth switch is coupled with a third power source for supplying a third voltage, a first terminal of the sixth switch is directly connected to a node between the third switch and the fourth switch, and a second terminal of the sixth switch is coupled with the third power source, and wherein a voltage difference between the first voltage and the second voltage is a sustain voltage.

2. The apparatus for driving a plasma display panel according to claim 1, wherein the first clamping section further includes a first capacitor and a second capacitor coupled in series with each other between the first power source and the second power source, wherein a node between the first capacitor and second capacitor is coupled to the second terminal of the fifth switch and the second terminal of the sixth switch.

3. The apparatus for driving a plasma display panel according to claim 1, further comprising:

a power recovery section formed between the first terminal of the panel capacitor and the third power source, wherein the power recovery section and recovers a reactive power used in the panel capacitor.

4. The apparatus for driving a plasma display panel according to claim 3, wherein the power recovery section includes:

at least one inductor having a first terminal thereof coupled to the first terminal of the panel capacitor; and seventh and eighth switches coupled in parallel between a second terminal of the inductor and the third power source.

5. The apparatus for driving a plasma display panel according to claim 1, wherein each of the first, second, third, fourth, fifth and sixth switches has a body diode.

6. The apparatus for driving a plasma display panel according to claim 1, further comprising:

a second driving section including a seventh switch and an eighth switch which are coupled in series between the first power source and a second terminal of the panel capacitor, and a ninth switch and a tenth switch which are coupled in series between the second terminal of the panel capacitor and the second power source; and a second clamping section including an eleventh switch and a twelfth switch, wherein a first terminal of the eleventh switch is directly connected to a node between the seventh switch and the eighth switch, a second terminal of the eleventh switch is coupled with the third power source, a first terminal of the twelfth switch is directly connected to a node between the ninth switch and the tenth switch, and a second terminal of the twelfth switch is coupled with the third power source.

7. An apparatus for driving a plasma display panel, which has a panel capacitor, the apparatus comprising:

a first driving section including a first switch and a second switch coupled in series between a first power source for supplying a first voltage and a first terminal of the panel capacitor, and a third switch and a fourth switch coupled in series between the first terminal of the panel capacitor and a second power source for supplying a second voltage, the first driving section alternately applying the first and second voltages to the first terminal of the panel capacitor by a driving operation of the first and second switches and the third and fourth switches, respectively; and a first clamping section including a fifth switch coupled between a first node between the first switch and the second switch and a third power source for supplying a third voltage, a sixth switch coupled between a second node between the third switch and the fourth switch and the third power source, wherein the fifth switch is turned on, with the first switch and the second switch off and the third switch and the fourth switch on; and the sixth switch is turned on, with the first switch and the second switch on and the third switch and the fourth switch off.

8. The apparatus for driving a plasma display panel according to claim 7, wherein each of the first, second, third and fourth switches each has a body diode.

9. The apparatus for driving a plasma display panel according to claim 7, wherein the fifth switch causes the withstand voltages of the first and second switches to be clamped to the difference between the first and third voltages and the difference between the third and second voltages, respectively, and the sixth switch causes the withstand voltages of the third and fourth switches to be clamped to the difference between the first and third voltages and the difference between the third and second voltages, respectively.

10. The apparatus for driving a plasma display panel according to claim 7, further comprising:

a second driving section including a seventh switch and an eighth switch coupled in series between the first power source and a second terminal of the panel capacitor, and a ninth switch and a tenth switch coupled in series between the second terminal of the panel capacitor and the second power source, the second driving section alternately applying the first and second voltages to the second terminal of the panel capacitor by a driving operation of the seventh and eighth switches and the ninth and tenth switches, respectively; and a second clamping section including an eleventh switch coupled between a third node between the seventh switch and the eighth switch and the third power source, and a twelfth switch coupled between a fourth node between the ninth switch and the tenth switch and the third power source, wherein the eleventh switch is turned on, with the seventh switch and the eighth switch off and the ninth switch and the tenth switch on; and the twelfth switch is turned on, with the seventh switch and the eighth switch on and the ninth switch and the tenth switch off.

11. The apparatus for driving a plasma display panel according to claim 7, further comprising:

a power recovery section including at least one inductor coupled to the first terminal of the panel capacitor, the power recovery section changing a terminal voltage of the panel capacitor using a resonance generated between the inductor and the panel capacitor.

12. The apparatus as claimed in claim 11, wherein the power recovery section stores energy in the inductor and changes the terminal voltage of the panel capacitor using energy stored in the inductor and the resonance, while the first terminal of the panel capacitor is sustained at the first or second voltage.

13. A method for driving a plasma display panel, in which the plasma display panel is driven by alternately applying first and second voltages through first and second signal lines coupled to one terminal of a panel capacitor, the method comprising steps:

(a) coupling a third voltage between a plurality of first switches formed on the second signal line, while the one terminal of the panel capacitor is fixed to the first voltage through the first signal line; and (b) coupling the third voltage between a plurality of second switches formed on the first signal line, while the one terminal of the panel capacitor is fixed to the second voltage through the second signal line.

14. The method as claimed in claim 13, wherein the step (a) includes coupling the third voltage to a node between two of the plurality of first switches formed on the second signal line, the step (b) including coupling the third voltage to a node between two of the plurality of second switches formed on the first signal line.

15. The method as claimed in claim 13, wherein the step (a) further includes raising the voltage of the one terminal of the panel capacitor to the first voltage using a resonance generated between an inductor coupled to the one terminal of the panel capacitor and the panel capacitor, and the step (b) further includes dropping the voltage of the one terminal of the panel capacitor to the second voltage using a resonance generated between the inductor and the panel capacitor.

16. The method as claimed in claim 15, wherein the step (a) further includes storing energy in the inductor through a path of the third voltage, the inductor and the second signal line, and the step (b) further includes storing energy in the inductor through a path of the first signal line, the inductor, and the thrid voltage.

* * * * *